United States Patent [19]

Reichardt et al.

[11] Patent Number: 4,678,262

[45] Date of Patent: Jul. 7, 1987

[54] CONTACT ELEMENT

[75] Inventors: Manfred Reichardt, Weinsberg; Rolf D. Loss, Heilbronn, both of Fed. Rep. of Germany

[73] Assignee: Allied Corporation, Morris Township, Morris County, N.J.

[21] Appl. No.: 918,191

[22] Filed: Oct. 14, 1986

Related U.S. Application Data

[63] Continuation of Ser. No. 730,216, May 3, 1985, abandoned.

[30] Foreign Application Priority Data

May 8, 1984 [DE] Fed. Rep. of Germany ..... 3416968

[51] Int. Cl.[4] ..... H01R 13/41; H01R 13/11

[52] U.S. Cl. ..... 439/857; 439/873

[58] Field of Search ..... 339/176 M, 220 R, 220 C, 339/220 L, 220 T, 221 R, 221 L, 221 M, 256 R, 256 SP, 258 R, 258 F, 258 P, 258 S

[56] References Cited

U.S. PATENT DOCUMENTS 3,663,931 5/1972 Brown ..... 339/256 R
3,732,529 5/1973 Weisenburger ..... 339/258 P
3,824,557 7/1974 Mallon ..... 339/227 R

FOREIGN PATENT DOCUMENTS 0068393 6/1982 European Pat. Off. .
2631107 2/1977 Fed. Rep. of Germany .
2823465 12/1979 Fed. Rep. of Germany .
2950097 7/1980 Fed. Rep. of Germany .
2093641 9/1982 United Kingdom ..... 339/221 M

*Primary Examiner*—Gil Weidenfeld
*Assistant Examiner*—Gary F. Paumen
*Attorney, Agent, or Firm*—Roger H. Criss

[57] ABSTRACT

A single piece contact element including a termination portion at one end, a female contact portion at the other end, a press fit region between the two portions, the press fit region being adapted to form a contacting region when the contact element is pressed into a circuit board. An opening is provided in the contact element in an area above the press fit region such that a press-in tool pin inserted through the female contact portion comes into engagement with a location of the contact element, which location is aligned with the longitudinal axis of the termination portion.

7 Claims, 2 Drawing Figures

CONTACT ELEMENT

This application is a continuation of application Ser. No. 730,216 filed May 3, 1985, now abandoned.

BACKGROUND OF THE INVENTION

1. Field of the Invention

This invention relates to a contact element which includes a female contact portion at a termination portion. The contact element of the invention is particularly useful for the so-called press fit technique according to which a pressing tool comes into direct engagement with several contact elements and presses the contact elements into a contact element receiving portion, for instance a circuit board.

2. Description of the Prior Art

European Patent Application No. 0 068 393 discloses a contact element having a female contact portion. The termination portion of such a contact element is adapted to be pressed into a circuit board. The required pressing force is transmitted by the upper portion of a housing via broadened portions of the contact element to a base plate, and from there to the termination portion. Thus, broadened portions are required to allow for the transmittal of the pressing force. Further, the known contact element is not a single piece design which means that the manufacture of such a contact element is complicated.

German Offenlegungsschrift No. 26 31 107 also discloses a contact element onto which the required pressing force is transmitted via the housing of the connector. For this purpose a sufficiently large surface area is required. Should the available surface area be not sufficient, then the plastic material of the housing may be overloaded with the consequence that the contact element penetrates into the housing.

It is an object of the present invention to provide a contact element which can be used in connection with the press fit technique.

Another object of the invention is to provide a contact element which can be used in a connector, specifically a connector of the elongated type useful e.g. for flat cables.

Another object of the invention is to provide a contact element which can be pre-assembled in the housing of a connector prior to mounting the connector elements by means of the press fit technique in a circuit board.

In accordance with another preferred object the contact element can be acted upon directly by means of the pressing tool without having the connector housing participate in the transfer of the pressing force.

Another object of the invention is to provide a contact element having a female contact portion such that it can be manufactured as a single piece by means of a stamping operation.

SUMMARY OF THE INVENTION

In accordance with this invention, there is provided a single piece contact element comprising a termination portion at one end, a female contact portion at the other end, a press fit region between the termination portion and the female contact portion, the press fit region being adapted to form a contactng region when the contact element is pressed into a contact opening of a circuit board, characterized in that there is provided an opening in the contact element in an area above the press fit region such that a press-in tool pin inserted through the female contact portion comes into engagement with a location of the contact element, which location is aligned with the longitudinal axis of the termination portion of the contact.

The contact element of this invention comprises a female contact portion having two oppositely arranged contact legs. The contact legs have the characteristic of a spring (contact spring). The contact surfaces provided by a plurality of said contact elements extend parallel to the longitudinal axis of an elongate connector.

With the design of the contact element of the invention it is possible to insert a plurality of the contact portions which are still connected to the support strip in rows into the housing of the connector.

Another advantage of the invention is the fact that the termination portion of the contact element can be used as a male contact inasmuch as the upper side and the bottom side of the sheet metal strip extends parallel to the longitudinal axis of the connector.

DESCRIPTION OF THE PREFERRED EMBODIMENTS

Figure 1:
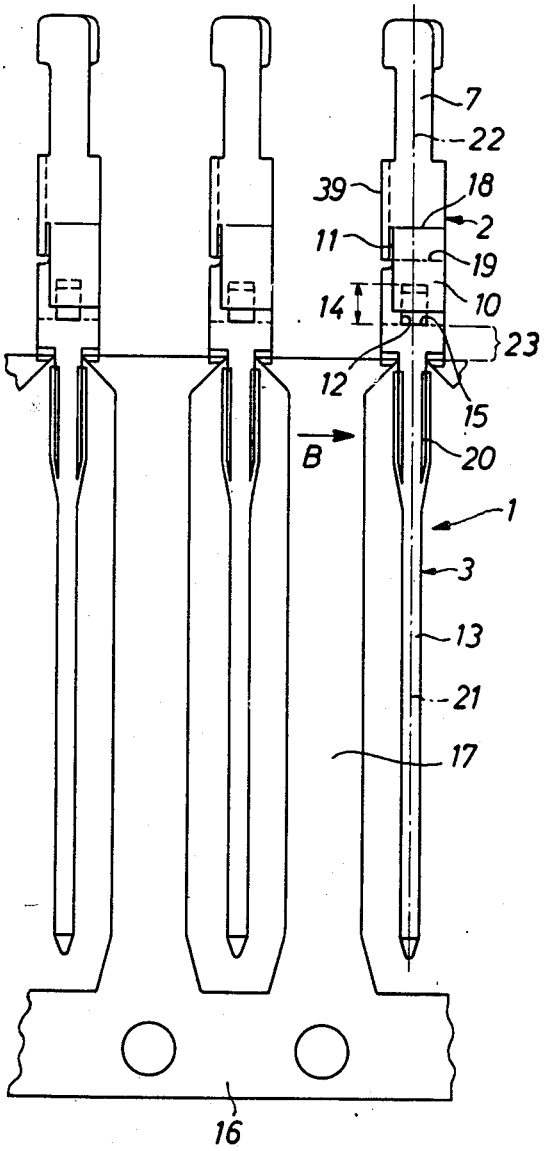
FIG. 1 is a side elevational view of a plurality of contact elements of the invention seen in the direction of arrow A in FIG. 2.
Figure 2:
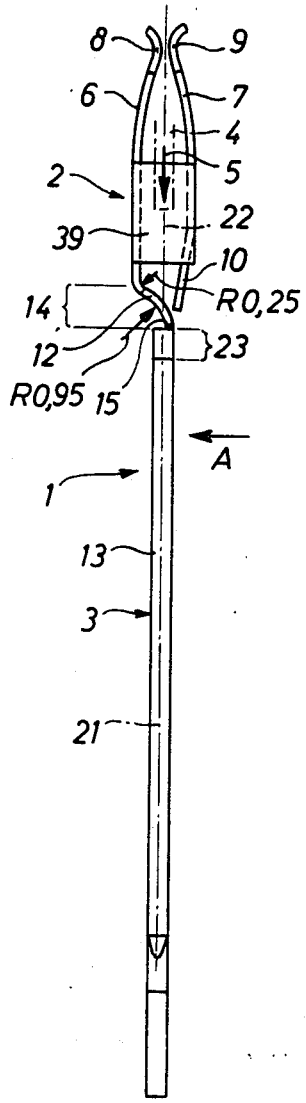
FIG. 2 is a side elevational view of a contact element of FIG. 1 seen in the direction of arrow B.

FIGS. 1 and 2 show a contact element 1 adapted to be pressed into a circuit board.

In FIG. 1 a plurality of contact elements 1 is shown still attached to remaining strip material 17 at a support strip 16. Inasmuch as all the contact elements 1 of FIG. 1 are identically formed, only the right most contact element in FIG. 1 will be described in detail below. The contact element 1 of FIG. 1 is shown in FIG. 2 as a side view looking in the direction of arrow B in FIG. 1.

The contact element 1 essentially comprises a female contact portion (contact spring portion) 2 and a termination portion 3 which is formed unitary with the female contact portion. The termination portion 3 comprises a press-fit region 20 adapted to be pressed into the mentioned circuit board (not shown). In the embodiment shown the pinlike termination portion 3 serves as a wire wrap post 13, but could also be used as a male contact (contact knife).

The female contact portion 2 which is formed unitary with the termination portion 3 comprises two oppositely arranged spring contact legs 6 and 7 which are connected with each other by means of a wall 39. At the free ends of the contact legs 6 and 7 the actual contacts 8 and 9 are provided.

The termination portion 3 which is designed as a male contact (or a wire wrap post) 13 comprises a longitudinal axis 21, the extension of which forms a longitudinal axis 22 of the female contact portion 2. A press-in tool pin 4 is shown as being arranged on the longitudinal axis 22 and is adapted to be moved in a press direction 5. A press-in tool will comprise in a known manner a plurality of such press-in pins 4. All said press-in pins 4 will be simultaneously introduced into a plurality of said female contact portions 2 so as to transmit a force onto said portions 2 for pressing said portions for instance into a circuit board.

For transmitting the required pressing force from the press-in tool pin 4 onto the contact element 1 the invention provides for a single piece contact element 1 (i.e. a contact element 1 in which the female contact portion 2 and the termination portion 3 are integral or form a single piece), and an opening 12 is provided in the contact element 1 in such a manner that the press-in tool pin 4 will engage the bottom border of the opening 12 (the engagement surface for the pin) in a substantially aligned manner with the longitudinal axis 21 of the termination portion 3.

In accordance with the invention it is provided that the contact element 1 forms a bent connecting portion 14. The connecting portion 14 is arranged at the upper end of a broadened region 23. The broadened region 23 is arranged adjacent to the press fit region 20. The connecting portion 14 comprises two opposite bends, one bend is designated R 0.95 and the other bend is designated R 0.25. The radius of curvature of the bend R 0.95 is larger than the radius of curvature of the bend R 0.25. In the area of the bend R 0.95 the said opening 12 is provided such that the pin 4 can come into engagement with the surface 15 of engagement while being aligned with the longitudinal axis 21. As mentioned, the surface 15 of engagement is formed by the bottom border of opening 12.

It is noted that the connecting portion 14 between the U-shaped bend female contact portion 2 and the termination portion 3 of the contact element is an extension of one leg 6 of the two legs of the female contact portion. This feature makes it possible that the contact surfaces of the two legs 6, 7 and of the termination portion 3 as well as the support strip 16 may extend parallel to the longitudinal axis of an elongated connector, i.e. a connector for a flat cable adapted to receive a plurality of contact elements. It should be noted that it is desirable that for elongated connectors the contact surfaces extend parallel to the longitudinal direction of the connector, because during the coupling operation of the connector an inclined position may be possible. In case that the connecting portions 14 would be connected to the wall 39, then the contact surfaces of the contact elements 1 would extend in perpendicular direction with respect to the longitudinal axis of the connector, a situation which is not desirable.

In accordance with a preferred embodiment of the invention an extension 10 is provided at one of the legs of the female contact portion 2. As is shown, the extension 10 is provided at leg 7. A slot 11 (see FIG. 1) permits bending the extension 10 in the manner shown in FIG. 2 in a direction towards the registered longitudinal axes 22 and 21 of the female contact portion 2 and termination portion 3, respectively. Line 18 shows the line of bending for extension 10. Line 19 in FIG. 1 shows the bottom end of wall 39.

The manufacture of the contact element of the invention starts from a sheet metal strip. The initial contour of the contact elements is stamped out of said sheet metal strip. The sequence of the stamping and bending operation can be freely selected. The opening 12 may be stamped out prior to forming the outer contour of the contact elements, or, for that matter, after stamping the outer contour.

What is claimed is:

1. A single piece contact element comprising a termination portion at one end, a female contact portion at the other end, a press fit region between said termination portion and said female contact portion, said press fit region being adapted to form a contacting region when said contact element is pressed into a contact opening of a circuit board, an opening in said contact element in an area above the press fit region, a receiving surface formed at said opening, and a connecting portion arranged between the press fit region and the female contact portion, the connecting portion being bent such that the longitudinal axis of the female contact portion is aligned with the longitudinal axis of the termination portion, said opening being formed in said bent connecting portion, said receiving surface being aligned with the longitudinal axis of the termination portion of the contact and said receiving surface being adapted to receive a press-in tool pin introduced through said female contact portion and said opening along the longitudinal axis of said female contact portion, to allow said contact element to be press-fitted into a contact opening of a circuit board.

2. The contact element of claim 1 wherein the opening is provided in a portion which is broadened with respect to the press fit region.

3. The contact element of claim 2 wherein the broadened portion is defined by two bent portions.

4. The contact element of claim 3 wherein the bent portions have a different radius of curvature.

5. The contact element of claim 1 wherein the female contact portion comprises two oppositely arranged contact spring legs which are connected by means of a wall.

6. The contact element of claim 5 wherein the female contact portion is provided with a guiding extension.

7. The contact element of claim 6 wherein said extension is an extension of one of said contact legs, and a slot is provided which allows the bending of the extension along a line such that the free end of the extension is arranged adjacent to said opening.

* * * * *